US006305205B1

(12) United States Patent
Derks et al.

(10) Patent No.: US 6,305,205 B1
(45) Date of Patent: Oct. 23, 2001

(54) UNIVERSAL ROLLING MILL STAND

(75) Inventors: Willi Derks, Kaarst; Hans-Jürgen Reismann, Düsseldorf; Egon Sippel, Niederkrüchten, all of (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 08/019,500

(22) Filed: Feb. 19, 1993

(30) Foreign Application Priority Data

Feb. 19, 1992 (DE) ..... 42 04 983

(51) Int. Cl.[7] ..... B21B 13/10
(52) U.S. Cl. ..... 72/225; 72/239
(58) Field of Search ..... 72/225, 237, 238, 72/239

(56) References Cited

U.S. PATENT DOCUMENTS 1,865,286 * 6/1932 Soderberg et al. ..... 72/225
4,557,130 * 12/1985 Bond ..... 72/225
4,715,206 * 12/1987 Forni ..... 72/237
4,907,437 * 3/1990 Poloni et al. ..... 72/225
5,031,435 * 7/1991 Seto et al. ..... 72/247

FOREIGN PATENT DOCUMENTS

0248708 * 11/1991 (JP) ..... 72/250

* cited by examiner

*Primary Examiner*—Joseph J. Hail, III
(74) *Attorney, Agent, or Firm*—Sidley Austin Brown & Wood, LLP

(57) ABSTRACT

A universal rolling mill stand with horizontal and vertical rolls, adjustably supported in two parallel roll posts is disclosed. The universal rolling mill stand enables a simple construction and operational process if the horizontal rolls are received, without the help of installation pieces in bearings disposed in the roll posts 3, operator side roll post with the bearings face away from the drive elements and can be moved away in rolling axis direction of the horizontal rolls, from the other roll post. Vertical rolls, supported in adapters, are slid into guide frames solidly connected with the roll posts.

6 Claims, 3 Drawing Sheets

UNIVERSAL ROLLING MILL STAND

FIELD OF THE INVENTION

The present invention is generally directed to a rolling mill stand and more particularly to a universal rolling mill stand with two horizontal and vertical rolls adjustably supported in parallel roll pillars.

BACKGROUND OF THE INVENTION

Universal rolling mill stands, operating in continuous or reversing operation, can roll the most versatile sections, for instance, double T and U-beams or rails. The horizontal and vertical sets of rolls of these universal rolling mill stands are disposed with installation pieces in window recesses of the pillar or post beams. The installation pieces of the horizontal rolls abut in pairs against the upper and lower transverse girders, which are retained by thrust nuts by pairs of adjustment spindles disposed opposite each other on both sides of the rolling train to be axially undisplaceable, but rotatably supported. To avoid lifting the transverse yokes from the remaining rolling mill stand parts in order to replace the rolls, the upper transfer yoke is divided into two parts so that it can be swiveled-out and back after the roll has been replaced and can be clamp-locked with the remaining stand part. In the outwardly swiveled position, the installation pieces receiving the rolls are freely accessible and can be removed from the stand through the window recesses. In order to achieve the inward and outward swiveling, swiveling mechanisms are required in addition to the installation pieces which altogether enable a meaningful roll replacement. These swiveling mechanisms are, for instance, additional hydraulic swivel cylinders.

SUMMARY OF THE INVENTION

It is therefore an object of the present invention to provide a universal rolling mill stand which does not require the use of installation parts.

Another object of the present invention to create a universal rolling mill stand which permits a simple construction and operation process.

These and other objects of the invention, which shall become hereafter apparent solved by the invention by locating horizontal rolls in bearings disposed in roll pillars or posts, without the use of installation parts. The roll post with the bearing which is located on the operator's side and facing away from the driving elements can be moved away in rolling axis direction of the horizontal rolls from the other roll post. The vertical rolls, supported in adapters, are slid into guide frames rigidly connected with the roll posts. The invention is based upon the fundamental consideration that a universal rolling mill stand, completely devoid of installation parts, can be realized by displacement of the roll posts on the operator side.

After displacement, the horizontal as well as the vertical rolls are exposed and are accessible from the inside of the pulled apart rolling mill stand. The installation pieces required for roll replacement, especially those of the vertical rolls, can be eliminated in the universal rolling mill stand of the invention since the guide frame rigidly connected to the roll posts or pillars fulfills all tasks otherwise performed by the installation piece of a vertical roll.

An adapter supporting the vertical roll can be directly brought into the installation position required for the rolling operation in the roll post or pillar by sliding into the guide frame. It is therefore no longer necessary to pass through an installation piece in a roundabout way. The guide frames therefore expediently comprise adapter recesses, accessible from the inside, through the roll posts, for instance, in the form slideways facilitating the pushing or sliding-in process.

In the invention, the guide frames are solidly connected to the roll posts or pillars through tie rods. It is indeed possible to fabricate the guide frames in a simple piece with the roll posts as a cast part. However, a multipart construction provides fabrication advantages which, in particular, permits an economical production of roll posts and guide frames by flame burners or autogenous cutting from a slab and results therefore in a simple steel design. The solid connection achievable through bracing by two or four tie rods is such that the guide frame position horizontally after its installation is able to carry the occurring rolling forces.

In the invention, the guide frames may be in two parts and comprise an adapter support part with a yoke or crosshead attached externally. When installing the guide frame, the crosshead and the adapter support or carrier part are fixed to the roll pillar or post by tie rods. The two-part construction of the guide frame affords the advantage of being able to dispose the vertical roll screw-down or adjustment system in the crossheads.

If the adapters are provided, their internally located sides facing the rolling gap with a spectacle-like mounting acted upon by the rolled material side guides located on the inlet and outlet ends, the adapter can also simultaneously be hydraulically pressed toward the rear against the adjustment system by the side guides, through the mounting (spectacle-like frame) and the system can thereby be balanced.

In a further refinement of the invention, horizontal rolls may be disposed in eccentric plates adjustable by worm gears. The horizontal rolls can be screwed down to the desired setting dimension by the worm gear which rotates the eccentrics To operate the universal rolling mill stand as a continuous rolling stand in the present invention, which could also be made available as a looping or change stand, it is advisable to utilize a vertical roll screw-down system, comprising a wedge adjustment and shim stock loaded by this wedge adjustment against the adapter. The universal rolling mill stand, continuously operating, is thus provided with a one-time adjustment, for which purpose the shim stock is attached from the rear in the web region to the adapter. The shims compensate the dressing to size dimension of the vertical rolls and enables an adjustment of the rolling gap to sections of different widths. On the other hand, the wedge adjustment serves for the fine adjustment, for instance with an adjustment travel of +/−5 mm, so that the roll wear and spring-back of the universal rolling mill stand can be corrected.

The simple construction of the universal rolling mill stand can be assisted by performing all adjustments manually by, for instance, a ratchet placed on the adjustments wedge. However hydraulic or electrometers are also suitable for this task, particularly if the universal rolling mill stand operates in the reversing mode. In that case, a hydraulic cylinder could be inserted between the crosshead and the adapter, where the shim stop is disposed in the mechanical wedge adjustment. The entire crosshead could be adjustable against the adapter support part and thus the adapter, together with the vertical roll, in the form of, for instance, two adjustment spindles synchronized with each other and disposed in mechanically driven adjustment nuts.

If a U-shaped abutment part is expediently disposed between the adapters and the roll screw down or adjustment systems, a good support or abutment for the vertical roll forces can be achieved towards the rear, meaning at the side facing away from the rolling gap or in the rolling or pitch line, namely by web-shaped segment of the U-shaped abutment part, providing a good support or bearing fact. The adapter itself and the replacement part, which must be slid into or out of the guide frame, comprises a top and bottom plate, as well as a support axis with bearings for the vertical roll fastened in those plates.

The universal rolling mill stand of the invention can be operated with single piece horizontal rolls. If alternatively multipart horizontal rolls braced by a tie rod to form a single unit are however utilized, the simple and economical type of construction of the universal rolling mill stand in the invention can be further promoted, because in case of worn roll barrels, the roll ring instead of the entire horizontal roll can be replaced.

BRIEF DESCRIPTION OF THE DRAWINGS

The invention will be better understood by the Detailed Description of the Preferred Embodiment, in connection with the Drawings, of which.

DETAILED DESCRIPTION OF THE PREFERRED EMBODIMENT

Figure 1:
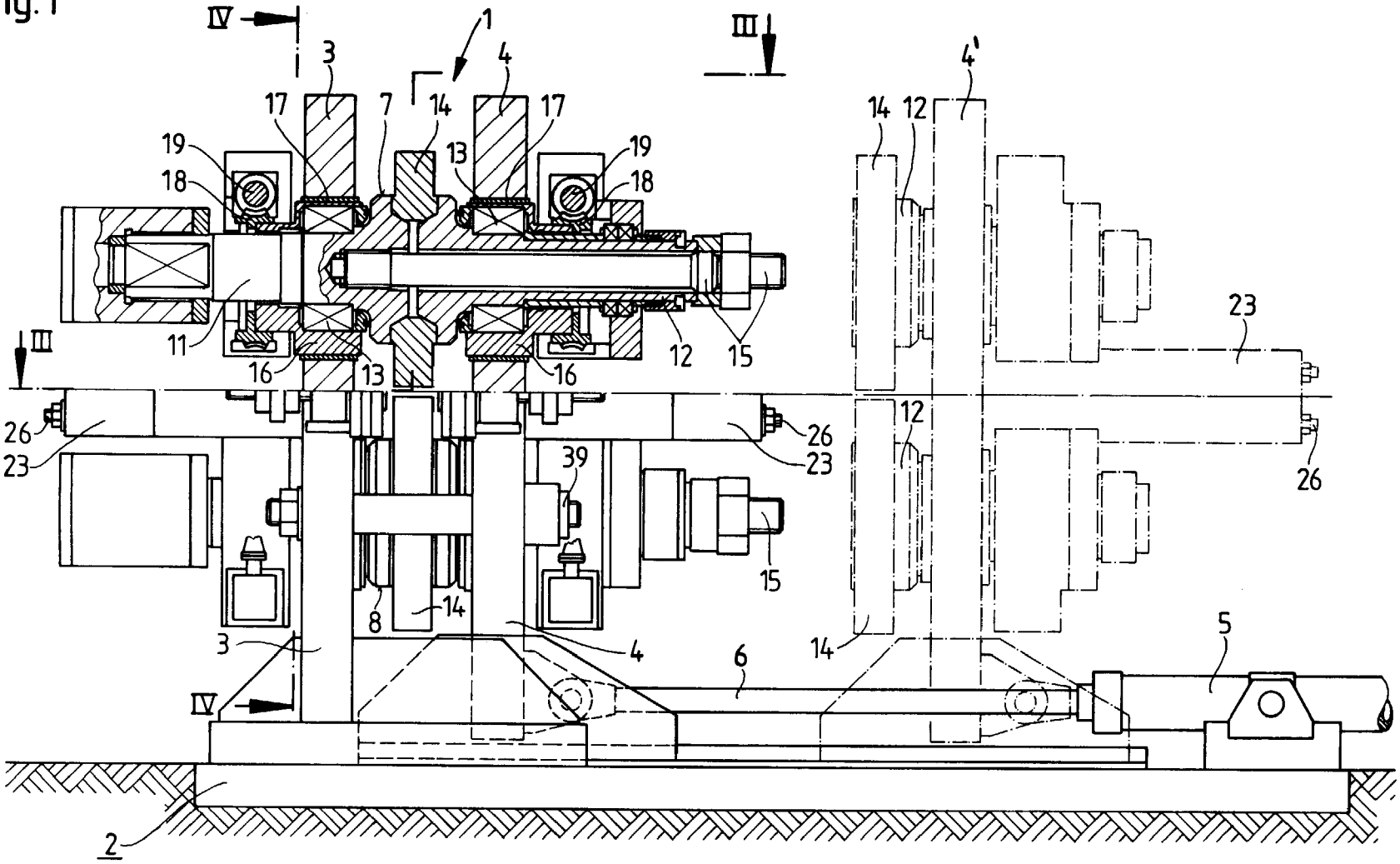
FIG. 1 is a front view of the universal rolling mill stand shown in section along line I—I in FIG. 2.
Figure 4:
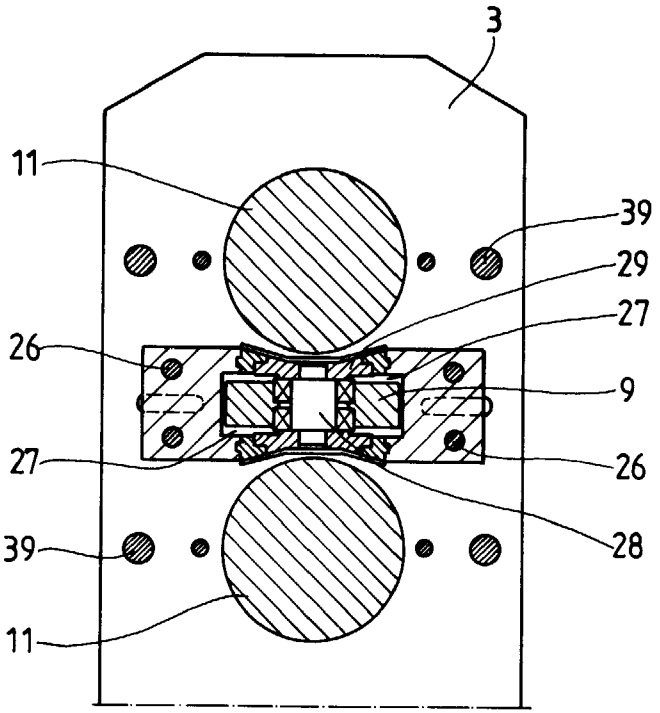
FIG. 4 is a cross-sectional view of the universal rolling mill stand in FIG. 1 along the line IV—IV.

Referring now to the drawings, wherein like numerals reflect like elements throughout the several views, FIG. 1 is a front view of universal rolling mill stand 1 comprising a roll post or pillar 3 on the drive side connected to a foundation base plate 2 and a mobile roll post 4 on the operator side. The roll posts 3, 4 are arranged parallel to each other and a displacement or adjustment cylinder 5, with a piston rod 6, engages at the roll post 4 on the operator side to move or drive the same away. The position of the roll post 4 upon the operator side moved away from the roll post 3 is shown in FIG. 4 by a dashed-dotted line (compare the roll post designated there with 4'). A top and bottom horizontal roll 7, 8, as well as two vertical rolls 9, are disposed in the roll posts 3, 4 without the use of installation pieces.

Figure 2:
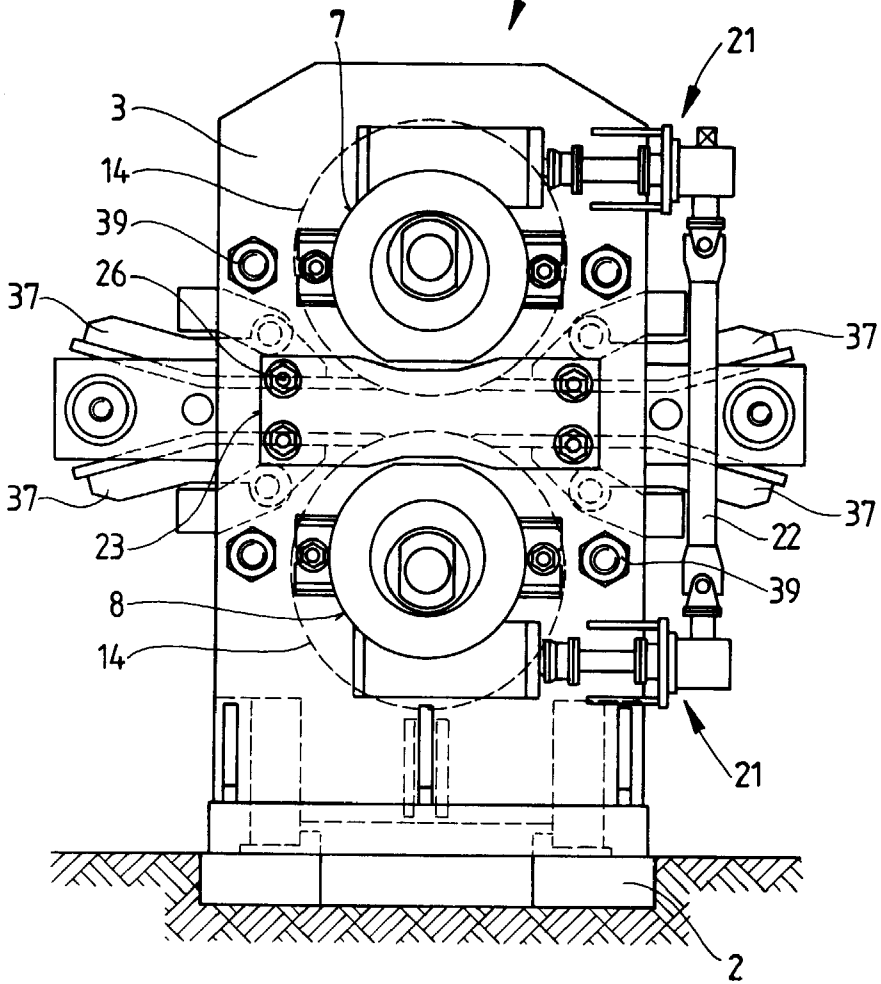
FIG. 2 is the universal rolling mill stand of FIG. 1 in side view.
Figure 3:
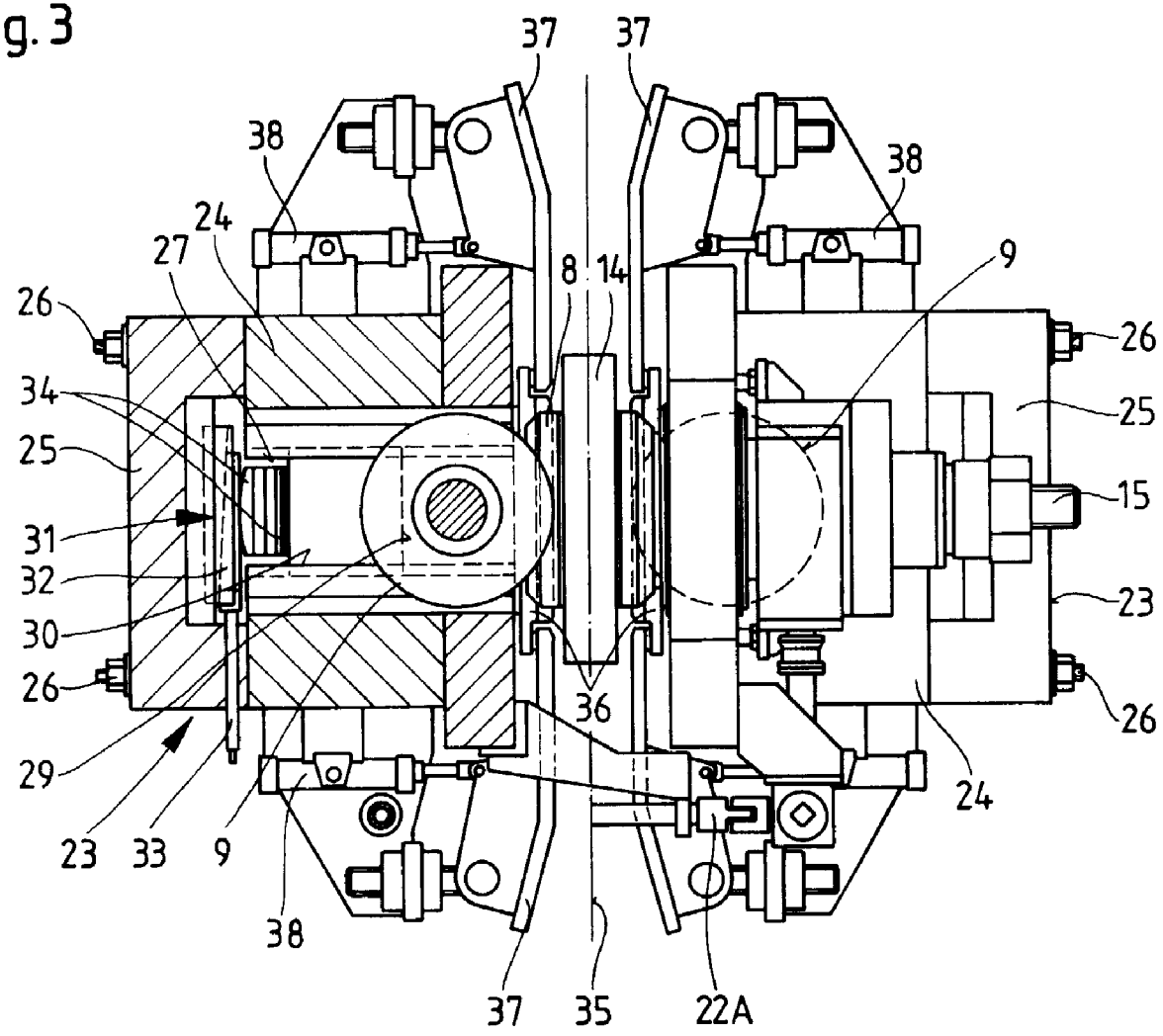
FIG. 3 is a plan view of the universal rolling mill stand in section along the line III—III in FIG. 1.

The horizontal rolls 7, 8 are configured in several parts (compare the upper half of FIG. 1) and comprise two support shafts 11, 12 of which one is supported in bearings 13 in the roll post 3 on the drive side and the other in the roll post 4 on the operator side. Between them, they enclose roll ring [or tire or jacket of a roll] 14 and are braced to form a single unit by a tie rod 15 pushed from the operator side through the support shaft 12 and extending up to support shaft 11. The bearings 13, of the horizontal rolls 7, 8, are located directly in the roll posts 3, 4. There they are embraced however by eccentric sleeves 16 disposed in a slide bushings 17. In addition, the slide bushings 17 are provided with a worm wheel 18 which meshes with a worm shaft 19 operated manually. The worm drive 21 (worm wheel 18 and worm shaft 19) for the top and bottom horizontal rolls 7, 8 are connected with each other by a common articulated or universal-shaft 22 and the worm drives 21 of the top horizontal roll are connected by a universal shaft 22A with each other from the drive to the operator side post 3. They are there mechanically synchronized (compare FIGS. 2 and 3). For adjustment of the horizontal rolls 7, 8 or of the tires of the rotary motion of the worm shafts 19 is transmitted by the wormwheels 18 and the eccentric sleeves 16 to the support shafts 11, 12 of the multipart horizontal rolls 7, 8 which, depending upon the rotational direction of the worm gear 21, either move away from or toward each other.

Just as the horizontal rolls 7, 8, the vertical rolls 9 are also disposed in the roll posts 3, 4 without the use of installation pieces. They are disposed in horizontal side guide frames 23. These are configured in two pieces and comprise an adapter carrier part 24 and a crosshead 25 placed thereupon from the outside (compare FIG. 3). The guide frame 23 (meaning the adapter carrier part 24) and the crosshead 25 are braced so solidly by four tie rods 26 (compare FIG. 4) to the roll posts 3, 4 that they can carry the vertical roling forces occrring during the rolling process The guide frames 23 are provided with an adapter recess 27 into which an adapter 29 receiving a vertical roll 9 upon a support axle 28 and comprising a top and bottom plate can be slid from the inside through the roll posts 3 or 4, after the roll posts 3, 4 have been moved apart into the position of the roll post 4' shown in FIG. 1 by a dashed-dotted line. A U-shaped abutment part 30 is allocated to the adapter 29, which is slid into the adapter recess 27 with its web pointing outwardly towards the crosshead 25, so that a large support face of the adapter 29, namely indirectly through the abutment part 30, is facing the crosshead 25 of the guide frame 23.

The vertical roll screw-down adjustment system 31 is disposed in the crosshead 25. The adjustment system 31 has the form of a wedge adjustment 32, where the adjustment wedge is displaceable manually by a threaded spindle 33. The wedge adjustment 32, serving of the fine adjustment, exerts an adjustment force upon the adapter 29 and thus upon the vertical roll 9, by shim stock 34 (which serves for course adjustment) fastened to the abutment part 30 and disposed between the crosshead 25 and the adapter 29.

The adapters 29 are provided with a spectacle-like mounting 36 at their internal sides facing the rolling gap or the rolling or pitch line 35, which are acted upon towards the outside by the rolling material side guides 37 which come to rest against the mountings 36—that is, in the direction of the roll screwed-down or adjustment system 31. Thus, they balance the vertical rolls 9 or the adapters 29. The force pressing the adapters 39 rearwards is provided by the cylinders 38 displacing the rolled material side guides 37.

In order to replace rolls, the tie rods 39 connecting the two roll posts 3, 4 of the universal roll mill stand 1 with each other are disconnected and the tie rod 15 bracing the horizontal rolls 7,8 to each other are also disconnected. The displacement cylinder 5 then moves the roll post 4 on the operators's side away from the roll post 3 into the position shown by a dash-dotted line in FIG. 1. The support shafts 12, the bearings 13, as well as the eccentric sleeve 16, together with the worm drive 21 (worm shaft 19 and worm wheel 18) herein remain in their fixed installation position. After the moving away process, the roll rings or tires 14 of the horizontal rolls 7, 8, as well as the adapter 29 with the vertical rolls 9, are freely accessible from the inside. The roll rings or tires 14 and/or the adapters 29 with the vertical rolls 9 can be removed from their installation position upon the support shaft 12 or in the adapter support part 24 of the guide frame 23 by, for instance, a portal crane in the rolling mill and a suitable gripping device and can be replaced by newly equipped adapters or new roll rings or tires. As soon as the roll post 4 on the operator side has been moved back into its operational position and is connected to the oppositely located roll post and as soon as the tie rods and the support shafts 11, 12 of the horizontal rolls 7, 8 are pretensioned or pretightened, the universal rolling mill stand 1 is again ready for operation.

While the preferred embodiment of the invention has been disclosed in detail, variations and adaptations may be made thereto without departing from the spirit and scope of the invention as delineated in the following claims:

What is claimed is:

1. A universal rolling mill stand, comprising:

horizontal and vertical rolls;

spaced first, drive side roll stand post and second operator's side roll stand post extending parallel to each other for supporting said horizontal and vertical rolls, the second, operator's side roll stand post being axially movable relative to the first, drive side roll stand post;

bearing means located in said first and second roll stand posts for supporting the horizontal rolls therein;

a horizontal guide frame located in each of said first and second roll stand posts for supporting a respective vertical roll therein;

tie rods for connecting the horizontal guide frame to a respective one of said first and second roll stands;

an adapter for receiving the respective vertical roll and arranged in said horizontal guide frame, said adapter having spaced separate horizontally extending top and bottom plates and a vertical support axle extending between said horizontal separate top and bottom plates for supporting the respective vertical roll, the guide frame comprising a recess for the adapter and accessible from a space between said first and second roll stand posts; and a U-shaped abutment part located in said recess for positioning said adapter in said recess, wherein said guide frames are configured in two parts, an adapter support part and a crosshead connected to said adapter support part and located on a side of a respective roll stand post remote from the space between said roll stand posts, wherein the universal rolling mill stand further comprises a vertical roll screw-down or adjustment system disposed in each crosshead, said U-shaped abutment part being disposed between said adapter and said roll screw-down or adjustment system.

2. The universal rolling mill stand of claim 1, wherein the vertical roll screw-down or adjustment system, comprises:

a wedge adjustment; and shimstock loaded against the adapter by said wedge adjustment.

3. The universal rolling mill stand of claim 1, wherein said horizontal rolls are single part horizontal rolls.

4. The universal rolling mill stand of claim 1, wherein said horizontal rolls are multipart horizontal rolls braced by tie rods (15) to form a single unit.

5. The universal rolling mill stand of claim 4, further comprising a worm drive, wherein the horizontal rolls are disposed in eccentrics displaceable or adjustable by the worm drive.

6. The universal rolling mill stand of claim 5, wherein the adapters are provided each with a mounting at an internal side thereof facing a rolling gap and located opposite of the mounting of another adapter; and wherein the rolling mill stand further comprises opposite rolling material side guides located at inlet and outlet sides and acting upon respective mountings.

* * * * *